US009822680B2

(12) United States Patent
Ferencak

(10) Patent No.: US 9,822,680 B2
(45) Date of Patent: Nov. 21, 2017

(54) EXHAUST GAS TREATMENT DEVICE, ESPECIALLY FOR AN EXHAUST GAS FLOW PATH OF AN INTERNAL COMBUSTION ENGINE, AND METHOD FOR MANUFACTURING AN EXHAUST GAS TREATMENT DEVICE

(71) Applicant: Eberspächer Exhaust Technology GmbH & Co. KG, Neunkirchen (DE)

(72) Inventor: Marcel Ferencak, Ostfildern (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 14/922,572

(22) Filed: Oct. 26, 2015

(65) Prior Publication Data

US 2016/0115834 A1 Apr. 28, 2016

(30) Foreign Application Priority Data

Oct. 27, 2014 (DE) ..... 10 2014 221 828

(51) Int. Cl.
*F01N 3/02* (2006.01)
*F01N 3/021* (2006.01)
(Continued)

(52) U.S. Cl.
CPC ..... *F01N 3/0217* (2013.01); *F01N 3/0211* (2013.01); *F01N 3/2853* (2013.01);
(Continued)

(58) Field of Classification Search
CPC .... F01N 3/0211; F01N 3/0217; F01N 3/2853; F01N 13/1888
(Continued)

(56) References Cited

U.S. PATENT DOCUMENTS 3,990,859 A * 11/1976 Waite ..... F01N 3/2853 29/446
5,996,228 A * 12/1999 Shoji ..... B01J 35/04 29/890
(Continued)

FOREIGN PATENT DOCUMENTS

DE 199 45 350 A1 2/2001
JP S60-47821 U 4/1985
(Continued)

OTHER PUBLICATIONS

English translation of Japanese Patent Application Publication No. JP 2003-176717A (Jun. 27, 2003).*
(Continued)

*Primary Examiner* — Jason Shanske
(74) *Attorney, Agent, or Firm* — McGlew and Tuttle, P.C.

(57) ABSTRACT

An exhaust gas treatment device for an exhaust gas flow path of an internal combustion engine, includes a tubular carrier body (12) extending along a longitudinal axis (L) of the carrier with a first axial end area (18) and with a second axial end area (20) and at least one exhaust gas treatment element (34) carried in the carrier body (12) with the interposition of at least one fiber material layer (36). The carrier body (2) includes carrier elements (14, 16) connected to one another in a first connection area (22) and in a second connection area (24) that extend from the first axial end area (18) to the second axial end area (20). At least one connection area (22, 24) does not extend in parallel to the longitudinal axis (L) of the carrier from the first axial end area (18) to the second axial end area (20).

20 Claims, 2 Drawing Sheets

(51) Int. Cl.
*F01N 3/28* (2006.01)
*F01N 13/18* (2010.01)

(52) U.S. Cl.
CPC ..... *F01N 13/1888* (2013.01); *F01N 2350/02* (2013.01); *F01N 2350/04* (2013.01); *F01N 2450/02* (2013.01); *F01N 2450/22* (2013.01)

(58) Field of Classification Search
USPC ..... 60/311; 29/890; 422/168
See application file for complete search history.

(56) References Cited

U.S. PATENT DOCUMENTS

| | | | | |
|---|---|---|---|---|
| 6,299,843 | B1 * | 10/2001 | Locker | F01N 3/2853 29/890 |
| 2007/0163118 | A1 | 7/2007 | Masoni | |
| 2007/0231222 | A1 | 10/2007 | Okabe | |
| 2008/0181831 | A1 * | 7/2008 | Okabe | F01N 3/2835 422/177 |
| 2009/0158588 | A1 * | 6/2009 | Nording | F01N 13/1811 29/890.08 |
| 2015/0033714 | A1 * | 2/2015 | Satoh | D21H 13/38 60/299 |

FOREIGN PATENT DOCUMENTS

| | | | |
|---|---|---|---|
| JP | 2003 176717 | A | 6/2003 |
| WO | 00/39437 | A1 | 7/2000 |

OTHER PUBLICATIONS

English translation of German Patent Application Publicaton No. DE 19945350 A1 (Feb. 2001).*

* cited by examiner

EXHAUST GAS TREATMENT DEVICE, ESPECIALLY FOR AN EXHAUST GAS FLOW PATH OF AN INTERNAL COMBUSTION ENGINE, AND METHOD FOR MANUFACTURING AN EXHAUST GAS TREATMENT DEVICE

CROSS REFERENCE TO RELATED APPLICATIONS

This application claims the benefit of priority under 35 U.S.C. §119 of German Patent Application 10 2014 221 828.4 filed Oct. 27, 2014, the entire contents of which are incorporated herein by reference.

FIELD OF THE INVENTION

The present invention pertains to an exhaust gas treatment device, which may be arranged, for example, in the exhaust gas flow path of an internal combustion engine in order to filter out soot particles from the exhaust gases leaving an internal combustion engine or to subject the exhaust gases to a catalytic reaction.

BACKGROUND OF THE INVENTION

In general, tubular carriers, which have an essentially cylindrical, for example, regular cylindrical design and extend along a longitudinal axis of the carrier, are installed in the exhaust gas flow path of exhaust gas treatment devices integrated in internal combustion engines. This carrier is provided with two carrier elements, which are, e.g., essentially identical and are also generally called half shells. The carrier elements have respective connection sections, which extend from the first axial end area of the carrier body to be manufactured to the second axial end area thereof essentially in parallel to the longitudinal axis of the carrier. When assembling a carrier body of an exhaust gas treatment device having such a design, an exhaust gas treatment element, which is designed, for example, as a soot particle filter element or as a catalytic converter element, is first arranged in one of the carrier elements, and the exhaust gas treatment element is surrounded in its outer circumferential area by at least one layer of fiber material permanently locking this exhaust gas treatment element in the finished carrier body. The other carrier element is subsequently moved onto the carrier element already containing the exhaust gas treatment element in a merging motion direction, and the connection sections of the two carrier elements are each arranged essentially in a plane directed at right angles to the merging motion direction. At the end of the motion of the two carrier elements towards one another, the connection sections of these carrier elements are mutually in contact with one another, so that two connection areas, in which the two carrier elements, which enclose and fix between them the exhaust gas treatment element surrounded by fiber material can be connected to one another, for example, by welding, are formed with the respective connection sections touching each other.

When manufacturing an exhaust gas treatment device in the above-described manner, the problem arises that fibers of the fiber material covering the exhaust gas treatment device move into the area between two connection sections brought into contact with one another and are pinched there. Since this makes it difficult or impossible to establish a stable and especially also exhaust gas-tight connection of the two carrier elements, the fibers of the fiber material must be pressed inwardly, in general, by hand before the final motion towards one another such that they will not protrude into the junction area of the connection sections of the two carrier elements, which said connection sections are to be connected to one another.

SUMMARY OF THE INVENTION

An object of the present invention is to provide an exhaust gas treatment device, especially for an exhaust gas flow path of an internal combustion engine, in which the collection of fibers of the fiber material covering an exhaust gas treatment element in the contact area of two carrier elements is avoided.

According to a first aspect of the present invention, this object is accomplished by an exhaust gas treatment device, especially for an exhaust gas flow path of an internal combustion engine, comprising a tubular carrier body extending along a longitudinal axis of the carrier with a first axial end area and an axial end area and at least one exhaust gas treatment element carried in the carrier body with the interposition of at least one layer of fiber material. The carrier body comprises two carrier elements connected to one another in a first connection area and in a second connection area. The first connection area and the second connection area extend from the first axial end area to the second axial end area. At least one connection area does not extend in parallel to the longitudinal axis of the carrier from the first axial end area to the second axial end area.

Due to the fact that at least one connection area and preferably both connection areas is/are designed such that this connection area or these connection areas does not/do not extend in parallel to the longitudinal axis of the carrier, e.g., they extend essentially skew in relation to this longitudinal axis, such a force is exerted on the fiber material covering an exhaust gas treatment element during the motion of the two carrier elements towards one another in a merging motion direction that is directed, in general, essentially at right angles to the longitudinal axis of the carrier that fibers of the fiber material will not be pulled towards the outside but are pressed inwardly and thus they will not accumulate where the two carrier elements come into mutual contact in the two connection areas and are to be connected to one another. This eliminates processing operations for pressing the fibers inwardly before the two carrier elements are moved towards one another and are brought mutually into contact with one another.

It is proposed in a variant, which is especially advantageous based on the especially simple design, which can therefore also be manufactured in a cost-effective manner, that the first connection area extend at an angle in relation to a reference plane containing the longitudinal axis of the carrier from the first axial end area to the second axial area and that the second connection area extend at an angle in relation to the reference plane to the first connection area from the first axial end area to the second axial end area.

To make it possible to achieve the integration of the exhaust gas treatment device according to the present invention in an exhaust gas flow path of an internal combustion engine in a simple manner, it is proposed that the carrier body have an essentially cylindrical design, preferably with a round, for example, circular or elliptical circumferential contour, and that the first connection area and the second connection area extend helically around the circumference of the carrier body from the first axial end area to the second axial end area.

A stable connection of the two carrier elements to one another can be achieved in a simple manner, for example, by the first carrier element and the second carrier element comprising each a connection section extending essentially radially outwardly in relation to the longitudinal axis of the carrier in the first connection area and in the second connection area.

To obtain a simple design, it is proposed that the first carrier element and the second carrier element be designed as preferably mutually identical shaped sheet metal parts. Furthermore, an especially exhaust gas-tight connection of the two carrier elements to one another can be achieved by these being connected to one another by welding in the first connection area and in the second connection area.

At least one exhaust gas treatment element may be designed as a soot particle filter element. As an alternative or in addition, at least one exhaust gas treatment element may be designed as a catalytic converter element.

According to another aspect of the invention, the object described above is accomplished by a method for manufacturing an exhaust gas treatment device, especially for an exhaust gas flow path of an internal combustion engine, wherein the exhaust gas treatment device comprises a tubular carrier body, which is provided with a first carrier element and with a second carrier element and extends along a longitudinal axis of the carrier, with a first axial end area and with a second axial end area, and at least one exhaust gas treatment element carried in the tubular carrier body with the interposition of at least one layer of fiber material, comprising the steps of a) providing the first carrier element with a first connection section and with a second connection section, such that the first connection section and the second connection section extend essentially in parallel to the longitudinal axis of the carrier from the first axial end area to the second axial end area, b) providing the second carrier element with a third connection section and with a fourth connection section such that the third connection section and the fourth connection section extend essentially in parallel to the longitudinal axis of the carrier from the first axial end area to the second axial end area, c) arranging the first carrier element such that the first connection section and the second connection section are located offset in relation to one another in a merging motion direction, d) arranging the second carrier element such that the third connection section and the fourth connection section are located offset in relation to one another in the merging motion direction, and e) moving the first carrier element and the second carrier element towards one another in the merging motion direction such that the first connection section comes into contact with the third connection section and the second connection section comes into contact with the fourth connection section.

It is ensured in this procedure according to the present invention based on the offset present in the respective connection sections of the carrier elements in relation to one another in the merging motion direction that fibers of a fiber material covering an exhaust gas treatment element will not be pulled outwardly during the final phase of the merging motion, but will be pressed inwardly in the direction of the exhaust gas treatment element and thus they will not accumulate in the mutual junction area of the connection sections coming into contact with one another.

To make it possible to avoid the development of tilting motions of one or both carrier elements during the final phase of the motion towards one another, it is proposed that when carrying out step e), the first connection section come into contact with the third connection section and the second connection section with the fourth connection section essentially simultaneously. This means that the offset of the first connection section in relation to the second connection section corresponds essentially to the offset between the third connection section and the fourth connection section at least during the final phase of the motion of the two carrier elements towards one another.

The method according to the present invention advantageously comprises, before step e), a step f) for positioning an exhaust gas treatment element enclosed by at least one layer of fiber material in the first carrier element or in the second carrier element.

Furthermore, a step g) for connecting the first connection section to the third connection section and the second connection section to the fourth connection section, preferably by welding, may be provided after step e).

If steps a) and b) comprise the provision of the first carrier element and of the second carrier element essentially as preferably mutually identical shaped sheet metal parts, the carrier body can be manufactured, on the one hand, in a simple and cost-effective manner, but it also consists, on the other hand, of a material that withstands the high temperatures generally developing in the exhaust gas flow path of internal combustion engines because of the heat being transported in the exhaust gases.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
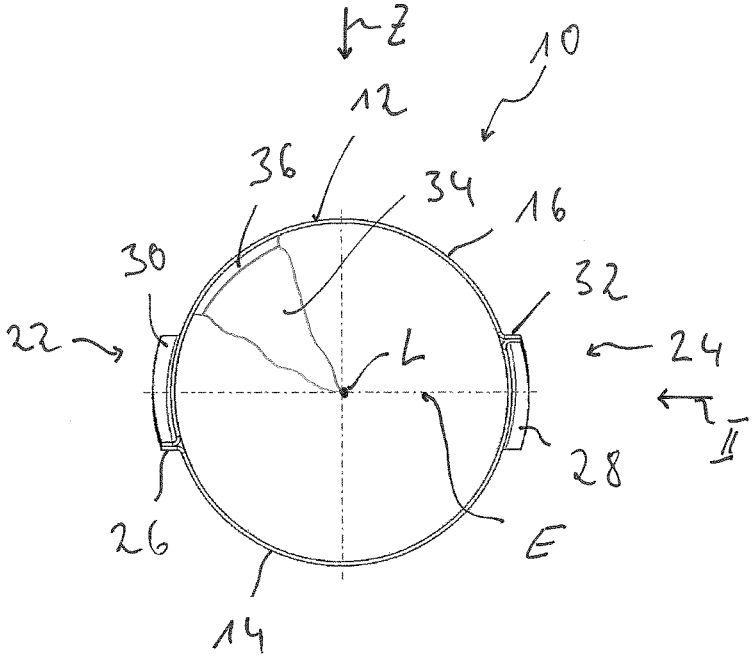
FIG. 1 is an axial view of an exhaust gas treatment device with a tubular carrier body and with an exhaust gas treatment element, which is arranged therein and is surrounded by fiber material.
Figure 2:
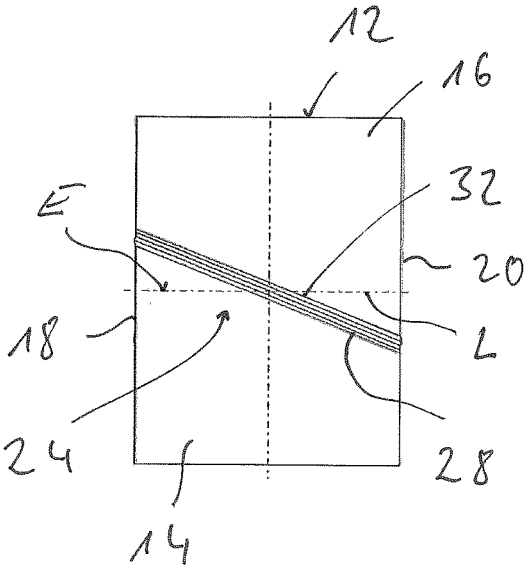
FIG. 2 is a side view of the exhaust gas treatment device according to FIG. 1 in viewing direction II in FIG. 1.

Referring to the drawings, FIGS. 1 and 2 show a first embodiment of an exhaust gas treatment device generally designated by 10. The exhaust gas treatment device 10 comprises a carrier body 12, which is formed from two carrier elements 14, 16 of an essentially mutually identical design in the example being shown. The two carrier elements 14, 16, which are generally also called half shells, are preferably provided as shaped sheet metal parts and form together a carrier body 12 of an essentially tubular, cylindrical shape, for example, with circular or elliptical circumferential contour.

The carrier body 12 extends along a longitudinal axis L of the carrier, which is directed essentially at right angles to the drawing plane in FIG. 1 and is in the drawing plane in FIG. 2. The carrier body 12 has a first axial end area 18 and a second axial end area 20. The carrier body 12 can be connected in these axial end areas 18, 20 to additional areas of the line of an exhaust gas flow path of an internal combustion engine.

The two carrier elements 12, 14 are permanently connected to one another at two connection areas 22, 24 located essentially diametrically opposite each other in relation to the longitudinal axis L of the body. In these connection areas 22, 24, the first carrier element 14 has a first connection section 26 for the first connection area 22, which connection section extends essentially radially outwardly in relation to the longitudinal axis L, as well as a second connection section 28 for the second connection area 24. The second carrier element 16 correspondingly has a third connection section 30 extending essentially radially outwardly in relation to the longitudinal axis L for the first connection area 22 and a fourth connection section 32 for the second connection area 24. The first connection section 24 of the first carrier element 14 is in contact with the third connection section 30 of the second carrier element 16 in the assembled state. The second connection section 28 of the first carrier element 14 is correspondingly in contact with the fourth connection section 32 of the second carrier element 16. The two carrier elements 14, 16 are permanently connected to one another, preferably by welding, in the area of these connection sections 26, 30 and 28, 32, which are preferably flatly in contact with one another.

It is clearly seen in FIGS. 1 and 2 that the two connection areas 22, 24 and hence also the connection sections 26, 30 and 28, 32 do not extend in parallel to the longitudinal axis L of the body. The two connection areas 22, 24 are positioned at an angle, i.e., in an angulated manner, in relation to a reference plane E, which contains the longitudinal axis L of the body and is intersected, for example, by the two connection areas 22, 24 in the central longitudinal area thereof. The two connection areas 22, 24 are positioned at opposite angles in relation to this reference plane E, so that the two connection areas 22, 24 extend essentially helically and in the same direction along the circumference of the carrier body 12 because of the essentially circular circumferential contour of the carrier body 12.

It becomes possible, especially because of the essentially diametrically opposite arrangement of the two connection areas 22, 24, for the two carrier elements 14, 16 to have an essentially mutually identical design. This leads to comparatively low manufacturing costs. The oblique position of the two connection areas 22, 24 ensures that fibers of the fiber material, which covers the exhaust gas treatment element 34 shown as a section only and is generally also called mounting mat and is provided, for example, as a fabric-like or nonwoven-like ceramic material, will not accumulate in the mutual junction area of the connection sections 26 and 30 as well as 28 and 32 in the manufacturing process of the exhaust gas treatment device 10 when the two carrier elements 14, 16 are moved towards one another in a merging motion direction Z. It rather ensures by the oblique position of the connection areas 22, 24 that the fibers will be pressed inwardly during the motion of the carrier elements 14, 16 towards one another in the merging motion direction Z. Manual finishing operations for removing fibers from the junction area of the two carrier elements 14, 16 prior to welding said carrier elements can thus be eliminated.

An alternative embodiment of an exhaust gas treatment device will be described below with reference to FIGS. 3 through 5. Components that correspond to previously described components in terms of design and mode of operation are designated by the same reference numbers with an "a" added.

Figure 3:
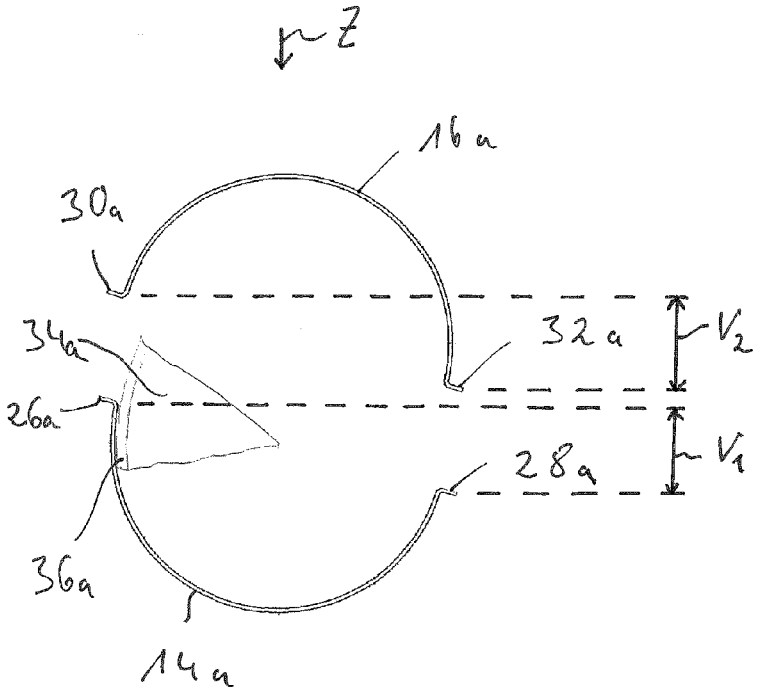
FIG. 3 is the two carrier elements of the carrier body of an exhaust gas treatment device of an alternative design before connection of said carrier elements to one another.
Figure 4:
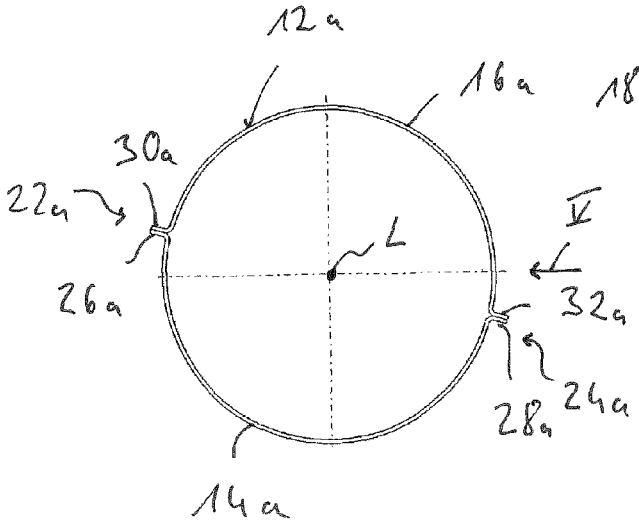
FIG. 4 is the two carrier elements of the carrier body according to FIG. 3 after connection of said carrier elements to one another.
Figure 5:
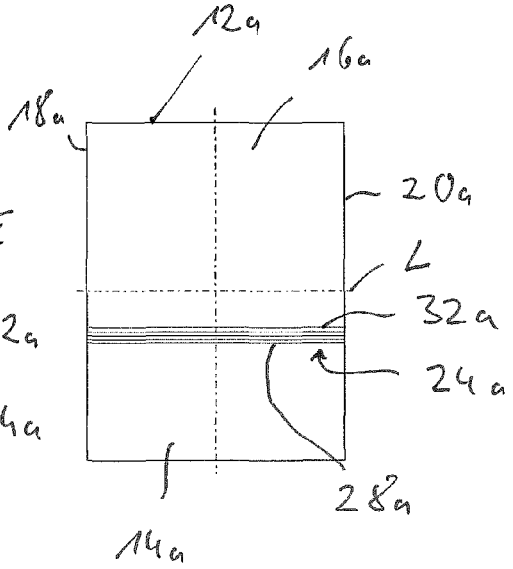
FIG. 5 is a side view of the carrier body shown in FIG. 4 in viewing direction V in FIG. 4.

In the embodiment of an exhaust gas treatment device 10*a* shown in FIGS. 3 through 5, the carrier body 12*a* is designed with two half shell-like carrier elements 14*a* and 16*a*, which are of an essentially mutually identical design and are provided, for example, as shaped sheet metal parts. The connection sections 26*a*, 28*a*, 30*a* and 32*a* providing the connection areas 22*a* and 24*a*, respectively, extend essentially in parallel to the longitudinal axis L of the carrier and are preferably located diametrically opposite each other in relation to said longitudinal axis.

When assembling this embodiment variant of an exhaust gas treatment device 10*a*, for example, the first carrier element 14*a* is positioned first such that its connection sections 26*a*, 28*a* are located offset in relation to one another in the merging motion direction and thus have, for example, an offset V1. Before or after positioning the carrier element 14 in this manner, the exhaust gas treatment element 34*a* enclosed by the fiber material 36*a* can be positioned in the carrier element 14*a*.

The second carrier element 16*a* is subsequently moved towards the first carrier element 14*a* in the merging motion direction Z. At least at the end of this merging motion, the second carrier element 16*a* is likewise positioned such that its connection sections 30*a* and 32*a* have an offset V2 in the merging motion direction Z, which is preferably essentially identical to the offset V1 of the two connection sections 26*a*, 28*a* of the carrier element 14*a*. The consequence of this is that because of the two carrier elements 14*a*, 16*a* being offset in the same direction, the respective connection sections 26*a*, 30*a* and 28*a*, 32*a* that are each to be brought into contact with one another will have essentially the same distance in the course of the motion towards one another, at least during the final phase of the motion, i.e., when the second carrier element 16*a* is being pushed over the exhaust gas treatment element 34*a* arranged in the first carrier element 14*a* and over the fiber material 36*a*. As a consequence, the connection sections 26*a* and 30*a* providing the first connection area 22*a* as well as the connection sections 28*a*, 32*a* providing the second connection area 24*a* will come mutually into contact essentially simultaneously. After establishing this contact, the two carrier elements 14*a* can be connected to one another permanently and in a gas-tight manner by welding in the two connection areas 22*a*, 24*a*.

Pinching of fibers of the fiber material 36*a* between the connection sections 26*a*, 30*a* and 28*a*, 32*a* located each opposite each other can also be very extensively avoided with the arrangement shown in FIGS. 3 through 5 because of the offset of the connection sections 26*a*, 28*a* and 30*a*, 32*a* in relation to one another, which offset is present during the motion of the two carrier elements 14*a*, 16*a* towards one another. Processing operations for pressing fiber material inwardly can thus be avoided.

It should finally be pointed out that the principles of the present invention may, of course, also be applied in another embodiment of the exhaust gas treatment device. For example, two or more exhaust gas treatment elements could be arranged in one carrier body. The carrier body could also have, in principle, a contour tapering in the direction of the longitudinal axis L of the body or a curved shape with correspondingly curved longitudinal axis of the body.

While specific embodiments of the invention have been shown and described in detail to illustrate the application of the principles of the invention, it will be understood that the invention may be embodied otherwise without departing from such principles.

What is claimed is:

1. An exhaust gas treatment device for an exhaust gas flow path of an internal combustion engine, the exhaust gas treatment device comprising:

a tubular carrier body extending along a carrier longitudinal axis between a first axial end area and a second axial end area;

at least one exhaust gas treatment element carried in the carrier body; and at least one fiber material layer interposed between the tubular carrier body and the at least one exhaust gas treatment element, wherein the carrier body comprises a first carrier element and a second carrier element connected to one another in a first connection area and in a second connection area, the first connection area and the second connection area extend from the first axial end area to the second axial end area, at least one of the connection areas does not extend in parallel to the carrier longitudinal axis from the first axial end area to the second axial end area.

2. An exhaust gas treatment device in accordance with claim 1, wherein:

the first connection area extends at an angle in relation to a reference plane containing the longitudinal axis of the carrier from the first axial end area to the second axial end area; and the second connection area extends at an opposite angle relative to the first connection area in relation to the reference plane from the first axial end area to the second axial end area.

3. An exhaust gas treatment device in accordance with claim 2, wherein:

the carrier body has an cylindrical design with a circular circumferential contour;

the first connection area and the second connection area extend helically in the same direction around the circumference of the carrier body from the first axial end area to a second axial end area.

4. An exhaust gas treatment device in accordance with claim 1, wherein:

the carrier body has a cylindrical design with a circular circumferential contour; and the first connection area and the second connection area extend helically in the same direction around the circumference of the carrier body from the first axial end area to a second axial end area.

5. An exhaust gas treatment device in accordance with claim 1, wherein the first carrier element and the second carrier element comprise a connection section each extending radially outwardly in the first connection area and in the second connection area.

6. An exhaust gas treatment device in accordance with claim 1, wherein the first carrier element and the second carrier element are mutually identical shaped sheet metal parts.

7. An exhaust gas treatment device in accordance with claim 1, wherein the first carrier element and the second carrier element are connected to one another by welding in the first connection area and in the second connection area.

8. An exhaust gas treatment device in accordance with claim 1, wherein at least one of:

the at least one exhaust gas treatment element comprises a soot particle filter element; and at least one exhaust gas treatment element comprises a catalytic converter element.

9. A method for manufacturing an exhaust gas treatment for an exhaust gas flow path of an internal combustion engine, wherein the exhaust gas treatment device comprises a tubular carrier body having a circular circumferential contour comprised of a half shell first carrier element and a half shell second carrier element and extends along a longitudinal axis of the carrier body, with a first axial end area and with a second axial end area, and at least one exhaust gas treatment element carried in the tubular carrier body with the interposition of at least one fiber material layer, the method comprising the steps of:

providing the half shell first carrier element with a first connection section and with a second connection section, such that the first connection section and the second connection section extend in parallel to the longitudinal axis of the carrier body from the first axial end area to the second axial end area;

providing the half shell second carrier element with a third connection section and with a fourth connection section, such that the third connection section and the fourth connection section extend in parallel to the longitudinal axis of the carrier body from the first axial end area to the second axial end area;

arranging the half shell first carrier element such that the first connection section and the second connection section are located offset in relation to one another in a merging motion direction;

arranging the half shell second carrier element such that the third connection section and the fourth connection section are located offset in relation to one another in the merging motion direction; and moving the half shell first carrier element and the half shell second carrier element towards one another in the merging motion direction such that the first connection section comes into contact with the third connection section and the second connection section comes into contact with the fourth connection section.

10. The method in accordance with claim 9, wherein when carrying out the step of moving, the first connection section comes into contact with the third connection section and the second connection section comes into contact with the fourth connection section simultaneously, the half shell first carrier element comprising a half shell first carrier element half circle contour, the half shell second carrier element comprising a half shell second carrier element half circle contour.

11. The method in accordance with claim 10, wherein the method further comprises the step of, prior to the step of moving, positioning at least one exhaust gas treatment element, enclosed by at least one layer of fiber material, in the first carrier element or in the second carrier element, the half shell first carrier element and the half shell second carrier element forming the tubular carrier body, wherein the circular circumferential contour of the tubular carrier body is defined by the half shell first carrier element and the half shell second carrier element.

12. The method in accordance with claim 10, wherein the method further comprises the step of, after the step of moving, connecting the first connection section to the third connection section and the second connection section to the fourth connection section by welding.

13. The method in accordance with claim 10, wherein the steps of providing the first carrier element and providing the second carrier element comprise providing the first carrier element and the second carrier element as mutually identical shaped sheet metal parts.

14. The method in accordance with claim 9, wherein the method further comprises the step of, prior to the step of moving, positioning at least one exhaust gas treatment element, enclosed by at least one layer of fiber material, in the first carrier element or in the second carrier element, the half shell first carrier element and the half shell second carrier element forming the tubular carrier body, wherein the circular circumferential contour of the tubular carrier body is defined by the half shell first carrier element and the half shell second carrier element.

15. The method in accordance with claim 9, wherein the method further comprises the step of, after the step of moving, connecting the first connection section to the third connection section and the second connection section to the fourth connection section by welding.

16. The method in accordance with claim 9, wherein the steps of providing the first carrier element and providing the second carrier element comprise providing the first carrier element and the second carrier element as mutually identical shaped sheet metal parts.

17. The method in accordance with claim 9, wherein the first connection section extends at an angle in relation to a reference plane containing the longitudinal axis of the carrier from the first axial end area to the second axial end area, the second connection second extending at an opposite angle relative to the first connection section in relation to the reference plane from the first axial end area to the second axial end area.

18. The method in accordance with claim 9, wherein the first connection section is connected to the third connection section in a plane and the second connection section is connected to the fourth connection section in the plane, wherein the plane is inclined relative to the longitudinal axis.

19. The method in accordance with claim 9, wherein the first connection section is offset from the second connection section by rotating the first carrier element about a first carrier element longitudinal axis of the first carrier element, the third connection section being offset from the fourth connection section by rotating the second carrier element about a second carrier element longitudinal axis of the second carrier element.

20. An exhaust gas treatment device for an exhaust gas flow path of an internal combustion engine, the exhaust gas treatment device comprising:

a tubular carrier body extending along a carrier longitudinal axis between a first axial end area and a second axial end area;

an exhaust component arranged in the carrier body; and at least one fiber material layer interposed between the tubular carrier body and the at least one exhaust gas treatment element, wherein the carrier body comprises carrier body components connected to one another in a first connection area and in a second connection area, the first connection area and the second connection area extend from the first axial end area to the second axial end area, at least one of the connection areas extending in a direction from the first axial end area to the second axial end area, the direction being different from a direction of the carrier longitudinal axis.

* * * * *